US009938611B2

(12) United States Patent
Yu

(10) Patent No.: US 9,938,611 B2
(45) Date of Patent: Apr. 10, 2018

(54) HIGH STRENGTH NODULAR CAST IRON POLE AND PREPARATION TECHNOLOGY THEREOF

(71) Applicant: Pei Yu, Liaoning (CN)

(72) Inventor: Pei Yu, Liaoning (CN)

( * ) Notice: Subject to any disclaimer, the term of this patent is extended or adjusted under 35 U.S.C. 154(b) by 536 days.

(21) Appl. No.: 14/416,436

(22) PCT Filed: Aug. 14, 2014

(86) PCT No.: PCT/CN2014/084392

§ 371 (c)(1),
(2) Date: Jan. 22, 2015

(87) PCT Pub. No.: WO2016/015365

PCT Pub. Date: Feb. 4, 2016

(65) Prior Publication Data

US 2016/0024623 A1 Jan. 28, 2016

(30) Foreign Application Priority Data

Jul. 28, 2014 (CN) ..... 2014 1 0363722

(51) Int. Cl.
*C22C 37/10* (2006.01)
*C22C 37/06* (2006.01)
(Continued)

(52) U.S. Cl.
CPC ..... *C22C 37/10* (2013.01); *C21D 5/00* (2013.01); *C21D 9/0068* (2013.01); *C22C 33/08* (2013.01); *C22C 37/04* (2013.01); *C22C 37/06* (2013.01)

(58) Field of Classification Search
CPC ..... C21D 5/00; C21D 9/0068; C22C 33/08; C22C 37/04; C22C 37/06; C22C 37/10
See application file for complete search history.

(56) References Cited

U.S. PATENT DOCUMENTS 4,569,617 A * 2/1986 Schmidt ..... E02D 5/285 285/332
8,302,368 B1 * 11/2012 Keel ..... E04H 12/342 138/120

(Continued)

FOREIGN PATENT DOCUMENTS

CN 102864269 A 1/2013
CN 203463804 U 3/2014
JP 2013133474 A 7/2013

*Primary Examiner* — Jenny R Wu
(74) *Attorney, Agent, or Firm* — Novick, Kim & Lee, PLLC; Allen Xue

(57) ABSTRACT

The invention discloses a high strength nodular cast iron pole and a preparation technology thereof. The preparation technology is characterized by comprising the following steps: (1) preparation before pole casting, to be specific, preparation of raw materials, smelting of iron, adding of alloying elements and nodulizing; (2) a pole casting procedure, to be specific, casting and inoculation treatment; and (3) heat treatment. The invention also provides the high strength nodular cast iron pole prepared by adopting the preparation technology, comprising multiple tower poles which are sequentially connected in an inserted manner, wherein each tower pole is a cone-frustum hollow column which has the conicity of 1000:11-26; the top end of the high strength nodular cast iron pole is equipped with a tower cap. The high strength nodular cast iron pole has the advantages of high bearing capacity, thin wall thickness, light weight, low manufacturing cost and the like.

5 Claims, 3 Drawing Sheets

(51) Int. Cl.

| | |
|---|---|
| ***C22C 33/08*** | (2006.01) |
| ***C22C 37/04*** | (2006.01) |
| ***C21D 5/00*** | (2006.01) |
| ***C21D 9/00*** | (2006.01) |

(56) References Cited

U.S. PATENT DOCUMENTS

| | | | | |
|---|---|---|---|---|
| 9,091,097 | B2 * | 7/2015 | Holmes | E04C 3/36 |
| 2008/0023172 | A1 * | 1/2008 | Waugh | B22D 13/023 164/114 |

* cited by examiner

HIGH STRENGTH NODULAR CAST IRON POLE AND PREPARATION TECHNOLOGY THEREOF

TECHNICAL FIELD

The present invention relates to the technical field of electric power transmission, in particular to a high voltage electric pole technology.

BACKGROUND

The nodular cast iron poles in the existing technology are mostly made of common nodular cast iron which has the tensile strength of 420 MPa, the yield strength of 280 MPa and the elongation of 10%, so the poles are easily bent by ice and snow in case of extremely severe ice or snow weather to cause power outage. Moreover, the common nodular cast iron poles cannot reach required bearing capability until certain wall thickness is met, thus leading to increase of weight and cost of the common nodular cast iron.

SUMMARY OF THE INVENTION

The present invention has been devised to solve such technical problems, as low bearing capability, large thickness of pole wall, heavy weight and high cost of the common nodular iron cast poles, described above, and an object thereof is to provide a high strength nodular cast iron pole and a preparation technology thereof.

The technical methods adopted by the present invention are as follows:

a preparation technology of a high strength nodular cast iron pole is characterized by comprising the following steps:

① preparation before pole casting, including preparation of raw materials, iron smelting, adding of alloying elements and nodulizing;

A1: preparation of raw materials, wherein adopted raw materials include 90-95 wt % of foundry pig iron or blast-furnace molten iron and 5-10 wt % of steel scrap;

that is to say, the raw materials include 90-95 wt % of foundry pig iron and 5-10 wt % of steel scrap; or the raw materials include 90-95 wt % of blast-furnace molten iron and 5-10 wt % of steel scrap;

A2: iron smelting, including weighing raw materials according to the above-mentioned percentage by mass, sequentially adding the raw materials into a medium frequency furnace, starting a power source and raising temperature of the furnace to 1470-1500° C. to melt the raw materials;

A3: adding of the alloying elements, to be specific, is adding Cu, Mo, Ni and V according to the performances of the product, then the mass percentages of various elements in the molten iron are:

C: 3.4-3.8%, Si: 1.2-2.6%, Mn: 0.3-0.5%, Cu: 0.15-0.5%, Mo: 0.3-1.0%, Ni: 1-2%, V: 0.3-0.5%, P≤0.06%, S≤0.025%, Mg: 0.03-0.06%, and the rest of Fe and inevitable microelements; wherein Cu has the function of promoting graphitization and formation of pearlite so as to improve the strength and hardness of a casting; when the addition amount of Cu is too low, the strength of the casting is not improved obviously; and when the addition amount of Cu is too high, the brittle transition temperature of the casting is improved and the impact toughness of the casting is reduced;

Mo has the function of improving the strength of the casting, and when the addition amount of Mo is too high, the elongation and the impact toughness of the casting are reduced;

Ni has the function of improving the strength and impact toughness of the casting, and when the addition amount of Ni is too high, the casting is not easy to machine by reason of overhigh hardness;

V has the function of improving the tensile strength and the yield strength of the casting, and when the addition amount of V is too high, the hardness of the casting is raised, whereas the elongation is reduced;

A4: furnace front detection of metallic components by adopting an on-the-spot spectrum analyzer and nodulizing of molten iron which conforms to technological demands in the light of detection results;

A5: nodulizing process, to be specific, is nodulizing the molten iron by adopting a cored-wire injection nodulizing technology or a pour-over nodulizing technology, wherein the mass of the nodulizer is 1.3 wt % of the molten iron obtained in step A3, wherein the cored-wire injection nodulizing technology lies in that the molten iron conforming to the technological demands is poured into a ladle, and a cored wire for cored-wire injection is fed into the molten iron, the pour-over nodulizing technology lies in that the nodulizer is put into the ladle in advance, and then the molten iron conforming to the technological demands is poured into the ladle; and the mass percentages of various elements in the nodulizer are as follows:

Ba: 4-6%, Si: 65-70%, Ca: 2-2.5%, Al<2%, Mn<0.4%, Cr<0.4%, P<0.04%, S<0.02%, and the rest of Fe and inevitable microelements;

② a pole casting procedure: casting and inoculation treatment; wherein the addition amount of an inoculant is 0.1-0.25 wt % of nodulized molten iron;

the casting and inoculation treatment lies in that the nodulized molten iron is cast to a water-cooling mold and rapidly solidified to form a conical cast pole, and the inoculant is instantly added to the molten iron during casting; and the mass percentages of various elements in the inoculant are: Si: 55-65%, Ba: 12-16%, Ca: 2-3%, C: 4-6%, Al: 3-3.5%, Mn<0.4%, Cr<0.4%, P<0.04%, S<0.02%, and the rest of Fe and inevitable microelements; and ③ heat treatment, including taking the cast pole out of the mold, and transferring the cast pole to a heat treatment furnace to undergo heat treatment, which is finished in such manners that in the heat treatment furnace, the cast pole is driven by a furnace chain to roll forwards and sequentially passes through a heating section, a heat preservation section, a rapid cooling section, a heating zone of a slow cooling section and a cooling zone of the slow cooling section; wherein, the cast pole is heated to 900-950° C. in the heating section, the heat preservation temperature of the heat preservation section is 720-760° C., and the total heat treatment time of the cast pole is 45-60 min.

The present invention also provides a high strength nodular cast iron pole prepared by adopting the above-mentioned preparation technology of the high strength nodular casting iron pole, which is characterized by comprising multiple tower poles which are sequentially connected in an inserted manner, wherein each tower pole is a cone-frustum hollow column which has the conicity of 1000: 11-26; the top end of the high strength nodular cast iron pole is equipped with a tower cap Furthermore, the wall thickness of the cone-frustum hollow column is 5-10 mm.

The present invention has the advantages that:

1. In comparison to a common nodular cast iron which has the tensile strength of 420 MPa, the yield strength of 280 MPa and the elongation of 10%, the high strength nodular cast iron material in the present invention has the tensile strength reaching 500-600 MPa, the yield strength reaching 350-420 MPa and the elongation being more than or equal to 8%.

2. In comparison to a common nodular cast iron pole, the high strength nodular cast iron pole disclosed by the present invention has high bearing capability, and the wall thickness of which is reduced by 10-15% compared with that of the common nodular cast iron pole, thus the purpose of reducing the weight of the pole and lowering the cost is achieved.

Upon the above reasons, the present invention can be widely popularized in the fields of electric power transmission technology, and the like.

BRIEF DESCRIPTION OF THE DRAWINGS

The present invention will be described in further detail in conjunction with accompanying drawings and specific embodiments below.

Figure 1:
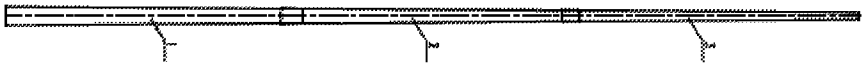
FIG. 1 is a structure schematic diagram of a high strength nodular cast iron pole in the embodiments of the present invention.

Wherein, 1 refers to bottom tower pole and 101 refers to bottom tower pole inserting portion;

2 refers to middle tower pole, 201 refers to middle tower pole receiving portion, and 202 refers to middle tower pole inserting portion;

3 refers to top tower pole, 301 refers to bottom tower pole receiving portion, and 302 refers to tower cap.

DETAILED DESCRIPTION OF THE PREFERRED EMBODIMENTS

A preparation technology of a high strength nodular cast iron pole, comprising the following steps:

① preparation before pole casting, including preparation of raw materials, melting of molten iron, adding of alloying elements and nodulizing;

A1: preparation of raw materials, wherein the adopted raw materials include 90-95 wt % of foundry pig iron and 5-10 wt % of steel scrap;

A2: iron smelting, including weighing raw materials according to the above-mentioned percentage by mass, sequentially adding the raw materials into a medium frequency furnace, starting a power source and raising temperature of the furnace to 1470-1500° C. to melt the raw materials;

A3: adding of the alloying elements, to be specific, is adding Cu, Mo, Ni and V according to the performances of the product, wherein the mass percentages of various elements in the molten iron are as follows:

3.72% of C, 1.23% of Si, 0.4% of Mn, 0.2% of Cu, 0.3% of Mo, 1% of Ni, 0% of V, 0.06% of P, 0.027% of S, 0.03% of Mg and the rest of Fe and inevitable microelements;

A4: on-the-spot sample analysis of metallic components by adopting an on-the-spot spectrum analyzer and nodulizing of molten iron which conforms to technological demands in the light of the detection results;

A5: nodulizing process, to be specific, is nodulizing the molten iron by adopting a cored-wire injection nodulizing technology, wherein the mass of the nodulizer is 1.3 wt % of the molten iron obtained in step A3, the molten iron which conforms to the technological demands is poured into a ladle, then a cored wire for nodulizing is fed into the molten iron, and the mass percentages of various elements in the nodulizer are as follows:

4-6% of Ba, 65-70% of Si, 2-2.5% of Ca, less than 2% of Al, less than 0.4% of Mn, less than 0.4% of Cr, less than 0.04% of P, less than 0.02% of S, and the rest of Fe and inevitable microelements;

② A pole casting procedure: casting and inoculation treatment; wherein the addition amount of an inoculant is 0.1-0.25 wt % of nodulized molten iron;

the casting and inoculation treatment lies in that the nodulized molten iron is cast to a water-cooling mold and rapidly solidified to form a conical cast pole, and the inoculant is instantly added to the molten iron during casting; and the mass percentages of various elements in the inoculant are as follows: 55-65% of Si, 12-16% of Ba, 2-3% of Ca, 4-6% of C, 3-3.5% of Al, less than 0.4% of Mn, less than 0.4% of Cr, less than 0.04% of P, less than 0.02% of S and the rest of Fe and inevitable microelements; and ③ annealing treatment, including taking the cast pole out of the mold, and transferring the cast pole to an annealing furnace to undergo annealing treatment, which is finished in such manners that in the annealing furnace, the cast pole is driven by a furnace chain to roll forwards and sequentially passes through a heating section, a heat preservation section, a rapid cooling section, a heating zone of a slow cooling section and a cooling zone of the slow cooling section; wherein, the cast pole is heated to 900-950° C. in the heating section, the heat preservation temperature of the heat preservation section is 720-760° C., and the total heat treatment time of the cast pole is 45-60 min; cementite and a part of pearlite in a matrix are decomposed after pole casting is finished, and finally a matrix structure based on cementite and pearlite is obtained.

The pearlite accounts for 55-65% of the overall cast pole by content after heat treatment, and has the tensile strength of 560 MPa, the yield strength of 392 MPa and the elongation of 10%.

The high strength nodular cast iron pole prepared by adopting the preparation technology of the high strength nodular cast iron pole comprises multiple tower poles which are sequentially connected in an inserted manner, wherein each tower pole is a cone-frustum hollow column which has the conicity of 1000: 11-26; the top end of the high strength nodular cast iron pole is equipped with a tower cap, and the wall thickness of each cone-frustum hollow column is 5-10 mm.

Figure 2:
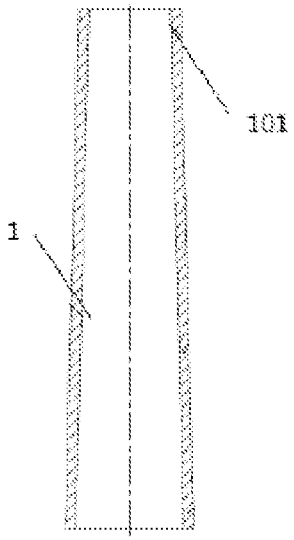
FIG. 2 is a structure schematic diagram of a bottom tower pole in the embodiments of the present invention.
Figure 3:
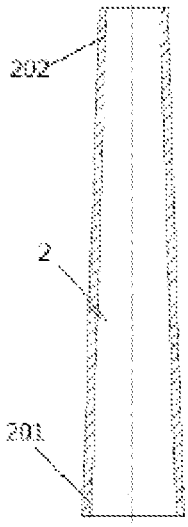
FIG. 3 is a structure schematic diagram of a middle tower pole in the embodiments of the present invention.
Figure 4:
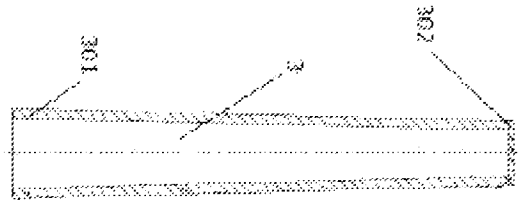
FIG. 4 is a structure schematic diagram of a top tower pole in the embodiments of the present invention.

As shown in FIG. 1, the high strength nodular cast iron pole consists of a bottom tower pole 1, a middle tower pole 2 and a top tower pole 3, all of which are cone-frustum hollow columns each of which has the conicity of 1000:16, and the wall thickness of each cone-frustum hollow column is 10 mm. As shown in FIG. 2, a bottom tower pole inserting portion 101 is arranged at the top of the bottom tower pole 1, the length of the bottom tower pole inserting portion 101 is twice its outer diameter of the end surface, and the outer diameter of the bottom of the bottom tower pole 1 is φ600 mm;

As shown in FIG. 3, a middle tower pole receiving portion 201 is arranged at the bottom of the middle tower pole 2, a middle tower pole inserting portion 202 is arranged at the top of the middle tower pole 2, the middle tower pole receiving portion 201, the inner diameter of which is matched with the outer diameter of the bottom tower pole inserting portion 101, is as long as the bottom tower pole inserting portion 101, and the length of the middle tower pole inserting portion 202 is twice its outer diameter of the end surface;

As shown in FIG. 4, a bottom tower pole receiving portion 301 is arranged at the bottom of the top tower pole 3, a tower cap 302 is arranged at the top of the bottom tower pole 2, the bottom tower pole receiving portion 301, the inner diameter of which is matched with the outer diameter of the middle tower pole inserting portion 202, is as long as the middle tower pole inserting portion 202, and the outer diameter of the tower cap 302 is φ400 mm.

Symbols and names of main chemical elements used in the present invention are explained as follows: C: carbon, Si: silicon, Mn: manganese, P: phosphorus, S: sulphur, Al: aluminum, Fe: ferrum, Ca: calcium, Mg: magnesium, Mo: molybdenum, Ni: nickel, V: vanadium, Ba: barium and Cr: chromium.

As stated above, the preferable embodiments abovementioned of the present invention are described, however, the present invention is not limited to these embodiments specifically disclosed, equivalent replacement or change, made by any technical personnel skilled in the art disclosed in the present invention in accordance to the technical solution and inventive concept of the present invention, should fall into the protection scope of the present invention.

The invention claimed is:

1. A nodular cast iron pole, comprising a plurality of tower poles connected in a series, wherein each tower pole comprises a cone-frustum hollow column, wherein one end of the tower pole leading the series comprises a tower cap, wherein each of the plurality of tower poles are manufactured using a method comprising the steps of:

melting a raw material in a medium frequency furnace at a temperature of 1470-1500° C., wherein the raw material comprises 90-95 wt % of foundry pig iron or blast-furnace molten iron and 5-10 wt % of steel scrap to form a molten iron;

adding alloying elements into the molten iron so that the molten iron comprises 3.4-3.8% of C, 1.2-2.6% of Si, 0.3-0.5% of Mn, 0.15-0.5% of Cu, 0.3-1.0% of Mo, 1-2% of Ni, 0.3-0.5% of V, less than or equal to 0.06% of P, less than or equal to 0.025% S, 0.03-0.06% of Mg, and a balance of Fe, wherein the percentage values are based on a total weight of the molten iron containing the alloying elements;

nodulizing the molten iron containing the alloying elements, wherein the step of nodulizing comprises adding a nodulizer to the molten iron containing the alloying elements to obtain a nodulized molten iron, wherein an amount of the nodulizer added is 1.3 wt % of the molten iron containing the alloying elements, and the nodulizer comprises, based on a total mass of the nodulizer, 4-6% of Ba, 65-70% of Si, 2-2.5% of Ca, less than 2% of Al, less than 0.4% of Mn, less than 0.4% Cr, less than 0.04% of P, less than 0.02% of S, with a balance of Fe;

casting the nodulized molten iron and simultaneously adding an inoculant into a water-cooling mold to form a conical cast pole, wherein an amount of the inoculant is 0.1-0.25 wt % of the nodulized molten iron, wherein the inoculant comprises, based on the total mass of the inoculant, 55-65% of Si, 12-16% of Ba, 2-3% of Ca, 4-6% of C, 3-3.5% of Al, less than 0.4% of Mn, less than 0.4% of Cr, less than 0.04% of P, less than 0.02% of S, with a balance of Fe; and transferring the cast pole from the mold to a heat treatment furnace, wherein the cast pole sequentially passes a heating section, a heat preservation section, a rapid cooling section, a heating zone of a slow cooling section and a cooling zone of the slow cooling section, wherein the cast pole is heated to 900-950° C. in the heating section, the heat preservation section has a temperature of 720-760° C., and a total heat treatment time of the cast pole is 45-60 min, wherein the cast iron pole contains 55-65% of pearlite, and a wall thickness of the cone-frustum hollow column is 5-10 mm.

2. A method for preparing a nodular cast iron pole according to claim 1, comprising the steps of:

melting a raw material in a medium frequency furnace at a temperature of 1470-1500° C., wherein the raw material comprises 90-95 wt % of foundry pig iron or blast-furnace molten iron and 5-10 wt % of steel scrap to form a molten iron;

adding alloying elements into the molten iron so that the molten iron comprises 3.4-3.8% of C, 1.2-2.6% of Si, 0.3-0.5% of Mn, 0.15-0.5% of Cu, 0.3-1.0% of Mo, 1-2% of Ni, 0.3-0.5% of V, less than or equal to 0.06% of P, less than or equal to 0.025% S, 0.03-0.06% of Mg, and a balance of Fe, wherein the percentage values are based on a total weight of the molten iron containing the alloying elements;

detecting the composition of the molten iron in the furnace using a spectrum analyzer, and nodulizing the molten iron containing the alloying elements, wherein the step of nodulizing comprises adding a nodulizer to the molten iron containing the alloying elements to obtain a nodulized molten iron, wherein an amount of the nodulizer added is 1.3 wt % of the molten iron containing the alloying elements, and the nodulizer comprises, based on a total mass of the nodulizer, 4-6% of Ba, 65-70% of Si, 2-2.5% of Ca, less than 2% of Al, less than 0.4% of Mn, less than 0.4% Cr, less than 0.04% of P, less than 0.02% of S, with a balance of Fe;

casting the nodulized molten iron and simultaneously adding an inoculant into a water-cooling mold to form a conical cast pole, wherein an amount of the inoculant is 0.1-0.25 wt % of the nodulized molten iron, wherein the inoculant comprises, based on the total mass of the inoculant, 55-65% of Si, 12-16% of Ba, 2-3% of Ca, 4-6% of C, 3-3.5% of Al, less than 0.4% of Mn, less than 0.4% of Cr, less than 0.04% of P, less than 0.02% of S, with a balance of Fe; and transferring the cast pole from the mold to a heat treatment furnace, wherein the cast pole sequentially passes a heating section, a heat preservation section, a rapid cooling section, a heating zone of a slow cooling section and a cooling zone of the slow cooling section, wherein the cast pole is heated to 900-950° C. in the heating section, the heat preservation section has a temperature of 720-760° C., and a total heat treatment time of the cast pole is 45-60 min, forming the nodular cast iron pole of claim 1.

3. The nodular cast iron pole according to claim 1, having a tensile strength of 500-600 MPa.

4. The nodular cast iron pole according to claim 1, having a yield strength of 350-420 MPa.

5. The nodular cast iron pole according to claim 1, having an elongation of larger than or equal to 8%.

* * * * *